US008667826B2

(12) United States Patent
Huck

(10) Patent No.: US 8,667,826 B2
(45) Date of Patent: Mar. 11, 2014

(54) DEVICE FOR LEVELING METAL STOCK

(75) Inventor: Reiner Huck, Baden-Baden (DE)

(73) Assignee: ARKU Maschinenbau GmbH, Baden-Baden (DE)

( * ) Notice: Subject to any disclaimer, the term of this patent is extended or adjusted under 35 U.S.C. 154(b) by 370 days.

(21) Appl. No.: 13/003,508

(22) PCT Filed: Jul. 10, 2009

(86) PCT No.: PCT/EP2009/058846

§ 371 (c)(1),
(2), (4) Date: Mar. 8, 2011

(87) PCT Pub. No.: WO2010/007005

PCT Pub. Date: Jan. 21, 2010

(65) Prior Publication Data

US 2011/0174595 A1 Jul. 21, 2011

(30) Foreign Application Priority Data

Jul. 14, 2008 (EP) ..... 08012682

(51) Int. Cl.
*B21D 1/02* (2006.01)

(52) U.S. Cl.
USPC ..... 72/163; 72/164

(58) Field of Classification Search
USPC ..... 198/604, 608, 611, 626.3; 72/160, 163, 72/164, 241.2
See application file for complete search history.

(56) References Cited

U.S. PATENT DOCUMENTS

| | | | | |
|---|---|---|---|---|
| 4,313,322 | A * | 2/1982 | Malinowski et al. | 72/164 |
| 4,454,738 | A * | 6/1984 | Buta | 72/10.1 |
| 6,598,445 | B2 * | 7/2003 | Mohring et al. | 72/163 |
| 6,920,774 | B1 * | 7/2005 | Bergman et al. | 72/160 |
| 2008/0011036 | A1 | 1/2008 | Buta | |
| 2010/0162784 | A1 * | 7/2010 | Buta et al. | 72/226 |

FOREIGN PATENT DOCUMENTS

| | | |
|---|---|---|
| EP | 0 510 278 | 10/1992 |
| WO | WO 2007/010021 | 1/2007 |

* cited by examiner

*Primary Examiner* — Ramya Burgess
*Assistant Examiner* — Thomas Randazzo
(74) *Attorney, Agent, or Firm* — Cozen O'Connor

(57) ABSTRACT

A device for leveling metal stock, which is moved during operation from an infeed side of the device to an outfeed side, includes: an upper set of leveling rollers and a lower set of leveling rollers, each of which comprises a terminal leveling roller on the infeed side and another one on the outfeed side. A plurality of lower backup roller support blocks, each include a plurality of backup rollers, which serve to support the lower leveling rollers and are arranged in rows, wherein their axes of rotation are parallel to axes of rotation of the leveling rollers. At least one of the terminal lower leveling rollers of the set of lower leveling rollers is arranged so that it can be individually adjusted, wherein the at least one of the terminal lower leveling rollers is supported at each end in a lever arm.

13 Claims, 5 Drawing Sheets

DEVICE FOR LEVELING METAL STOCK

BACKGROUND OF THE INVENTION

1. Field of Invention

The present invention pertains to a device for leveling metal stock, also called a leveling machine, wherein the metal stock is moved during operation of the machine from an infeed to an outfeed side of the machine.

2. Discussion of Background Art

Devices of this type have been known for many years in the field of metal processing. They comprise an upper set of leveling rolls or rollers and a lower set of leveling rolls or rollers, each set comprising a terminal leveling roller on the infeed side and another terminal leveling roller on the outfeed side, wherein the upper and lower leveling rollers are arranged with an offset to each other, and wherein a plurality of upper and lower drive shafts is provided, which serve to drive the leveling rollers. A plurality of lower backup roller support blocks is also provided, each of which comprises a plurality of backup rollers, which serve to support the lower leveling rollers and which are arranged in rows, wherein their axes are parallel to the axes of the leveling rollers.

In certain applications, such as the leveling of large, heavy plates or the feeding of strip to press tools, a certain degree of intentional "overleveling" is desired. This is understood to mean an elective leveling of the material curvature.

Individually adjustable leveling rollers for this purpose are known from the prior art, these rollers being moved vertically to narrow the gap. This leads to the disadvantage that the distance between the adjustable roller and the adjacent leveling roller and its support is increased. Another disadvantage is that the adjusting mechanism required for this purpose is located vertically under the leveling roller and thus inside the leveling machine, which makes it much more difficult to assemble the machine.

SUMMARY OF THE INVENTION

The present invention is therefore based on a goal of creating a device for leveling metal stock in which the previously mentioned disadvantages are avoided and in particular it is possible to keep the distance between the leveling rollers at the minimum value.

This goal is achieved by the features of claim 1.

It is possible to keep the distance between the at least one terminal lower leveling roller and the adjacent leveling roller at the same small value as that also present in the remaining set of leveling rollers

- by designing at least one of the terminal lower leveling rollers of the lower set of leveling rollers of the leveling device so that it is individually adjustable, wherein it is supported at each end in a lever arm, the axis of rotation of which is the same as the axis of rotation of the backup roller installed directly adjacent to the terminal backup roller;
- by designing the terminal backup rollers assigned to the at least one terminal movable lower leveling roller, these backup rollers being arranged in a row, so that they are movable; and
- by providing mechanisms for the synchronous movement of the terminal backup rollers, wherein at least one of the terminal lower leveling rollers follows this movement, as a result of which especially good and easily adjustable results are obtained.

It is also advantageous for the mechanism for moving the assigned backup rollers to comprise a longitudinally movable slide for each movable backup roller of each backup roller support block. A slide of this type creates a simple way to shift the backup roller.

It is advantageous for the movable terminal backup rollers to comprise a smaller diameter than the other backup rollers of the backup roller support block, as a result of which a correspondingly compact design of the overall leveling machine can be retained.

It is also advantageous for the lever arm to be connected to a seating fixture for holding the last lower drive shaft, as a result of which the drive shaft can be kept in place and will not fall down when the leveling roller is removed or replaced.

It is also advantageous for the slide to move horizontally. This also contributes to the compact design of the overall device.

The mechanisms for synchronously moving the terminal backup rollers advantageously comprise an actuating drive, and the actuating drive can advantageously be formed by a hydraulic cylinder, a hoist gear, or a spindle drive.

It is also advantageous for the actuating drive to act only from the outside in, i.e., toward the set of leveling rollers, that is, in only one direction, and for the mechanisms for synchronously moving the terminal backup rollers to be subjected to the action of spring devices acting in the lowering direction of the terminal leveling roller, as a result of which the backup roller together with the slide is pushed away from the adjacent backup roller when the actuating drive returns to its starting position.

For the purpose of force transmission, it is also advantageous for a beam or a yoke to be provided between the actuating drive and the slide, as a result of which the necessary forces can be transmitted from the actuating drive to all of the slides by simple means.

It is also advantageous for each of the lever arms which support the lower terminal leveling roller to be supported pivotably in a side bearing bar.

It is especially advantageous for the adjustable lower terminal leveling roller to be installed on the outfeed side and/or on the infeed side of the leveling device. This makes it possible to overlevel on the outfeed side and/or to introduce the stock to be leveled more easily into the infeed side.

It is also advantageous for the mechanism for moving the lower terminal leveling roller on the outfeed side to be identical to that on the infeed side, so that only one design needs to be provided, which is suitable for both the outfeed and the infeed sides.

Through the use of the design described above, the additional advantage is also obtained that the mechanism for moving the leveling roller can be attached externally to the machine stand, as a result of which it becomes easier to retrofit the machine.

Through the use of the inventive solution, the advantage is also achieved that an individual leveling roller can still be replaced quickly, as in the past. The reason for this is that no cartridge is required, because the actuating mechanism is attached externally and there is no positive mechanical connection between it and the support blocks of the backup rollers. As a result, the backup roller support blocks can be removed in the same way as in the past.

BRIEF DESCRIPTION OF THE DRAWINGS

Additional details, features, and advantages of the present invention can be derived from the following description, which refers to the drawing.

DETAILED DESCRIPTION

In the figures, components and parts of the device which are the same have the same reference numbers.

Figure 1:
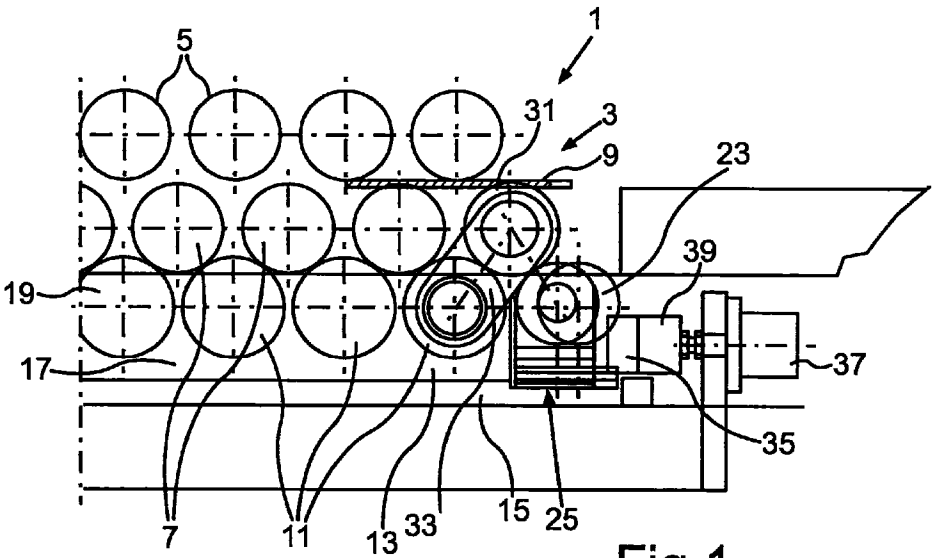
FIG. 1 shows a schematic partial side view of an inventive device for leveling metal stock, specifically of a leveling machine with an individually adjustable leveling roller.

FIG. 1 shows a partial side view of an inventive device 1 for leveling metal stock, also called a leveling machine. The device 1 comprises a leveling assembly 3, which comprises upper leveling rollers 5 and lower leveling rollers 7, which are arranged with an offset to each other. The metal stock 9 to be leveled is indicated schematically.

Underneath the lower leveling rollers 7 are backup rollers 11, which support the leveling rollers and which are themselves mounted rotatably in so-called backup roller support blocks 13.

Figure 2:
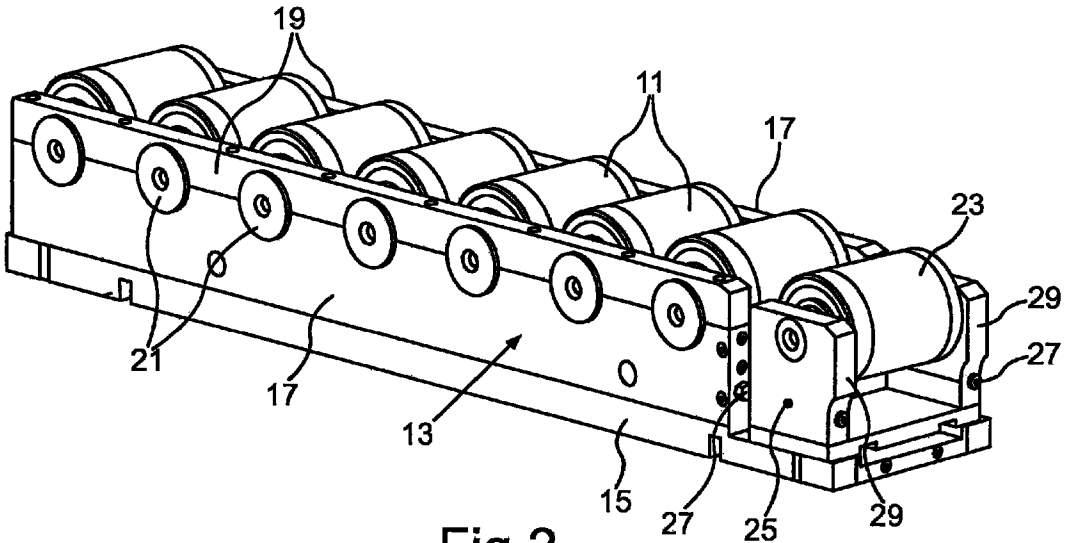
FIG. 2 shows a perspective view of a support block of lower backup rollers, which includes a terminal backup roller which can be shifted by a slide.

As can be seen more clearly in FIG. 2, which shows a perspective view of a backup roller support block 13, the backup roller support block 13 comprises a base plate 15 and side walls 17, in which the backup rollers 11 are supported. To this end, the side walls 17 are divided into two parts, and thus each comprises an upper fastening bar 19, which serves to hold the rotary bearings 21 of the backup rollers 11 in place.

As can also be seen clearly in FIG. 2, a terminal backup roller 23 is supported rotatably in a slide 25. The slide 25 is supported so that it can move horizontally on the base plate 15. A guide screw 27, one on each side of the backup roller support block 13, extends from the front end surface of the side wall 17 and proceeds all the way through the side wall 29 of the slide 25, wherein springs, which try to push the slide 25 away from the side walls 17 of the backup roller support block 13, are mounted on the screws.

The path along which the terminal backup roller 23 travels is shown schematically in FIG. 1. Together with the adjacent backup roller 11, it supports the terminal leveling roller 31, which is supported by a lever arm in such a way that it can rotate around the adjacent backup roller 11. The movement of the terminal lower leveling roller 31 is shown schematically in FIG. 1, as a result of which it is possible to "overlevel" the metal stock 9, as shown in FIG. 1.

The terminal lower leveling roller 31 is moved by the horizontal displacement of the terminal backup roller 23, the forward and rearward end positions of which are also indicated schematically in FIG. 1.

Figure 3:
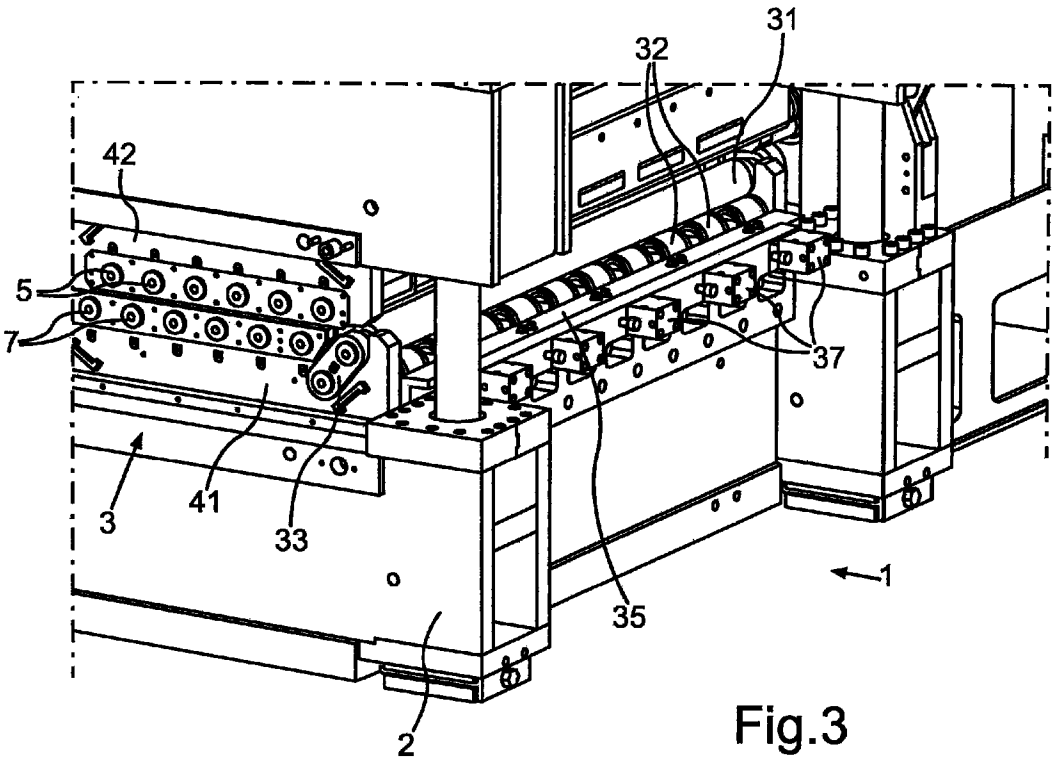
FIG. 3 shows a perspective partial view of an inventive device with an individually adjustable terminal lower leveling roller and with an actuating mechanism attached externally to the machine stand.

FIG. 3 shows a perspective view of the inventive device 1 for leveling metal stock, i.e., the leveling machine. It comprises a lower machine stand 2, in which the lower backup roller support blocks 13 and the lower leveling rollers 7, 31 are supported.

For the synchronous movement of the slides 25 and thus of the terminal backup rollers 23, a beam or yoke 35 is provided. As can also be derived from FIGS. 1 and 3, actuating drives 37 are attached externally to the machine stand 2 and are connected to the beam 35 by cylinders 39, as can be seen in FIG. 1.

Figure 4:
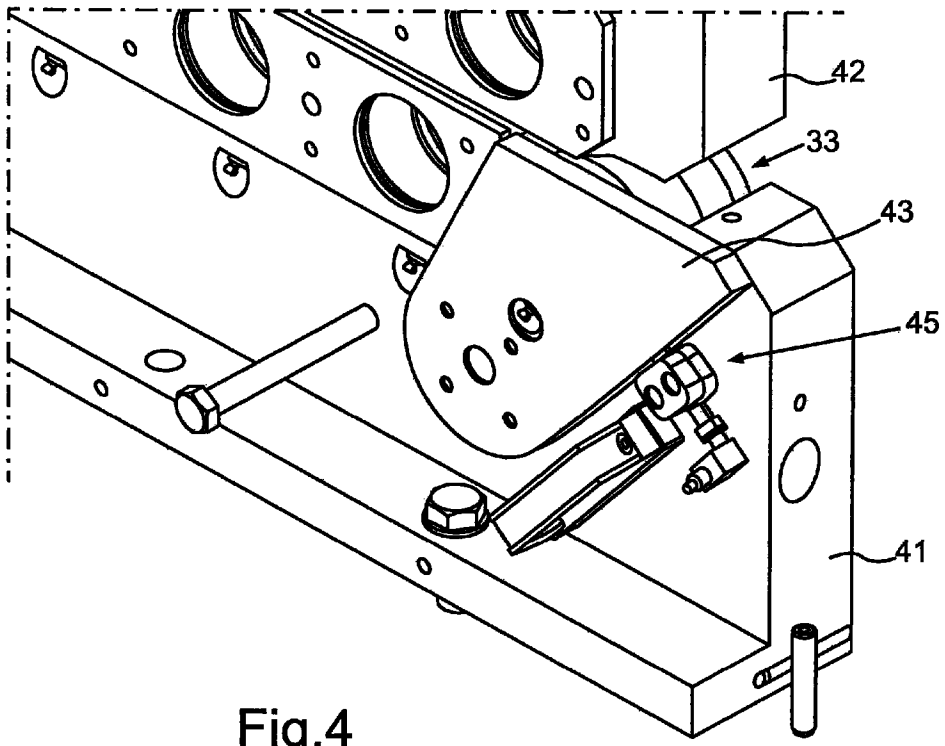
FIG. 4 shows a bearing bar from the front and from below, with a cover in the lower area for the lever arm for the individually adjustable leveling roller.
Figure 5:
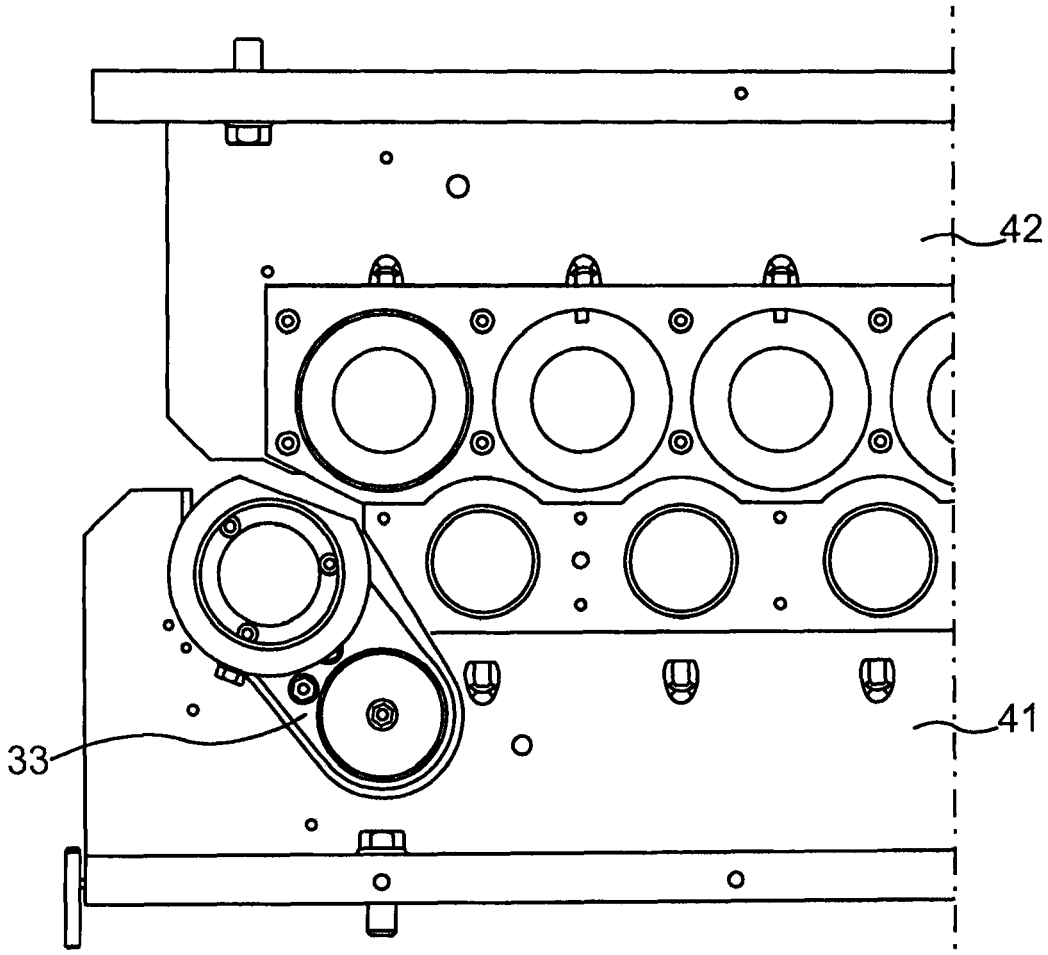
FIG. 5 shows a bearing bar from the rear, with the lever for the leveling roller in the lower area and a seating fixture for the drive shaft (diagram without the leveling rollers).

As can be seen in FIGS. 3-5, the lower leveling rollers 7 (not shown in FIGS. 4 and 5) are supported at each end in a lower bearing bar 41. In FIGS. 3 and 5, the lever arm 33 can also be clearly seen, whereas FIG. 4 shows an outer cover 43 over the lever arm 33. The upper leveling rollers are supported rotatably at each end in an upper bearing bar 42. In FIGS. 3-5, the terminal lower leveling roller 31 is shown in its lowered position; that is, the lever arm has been pivoted outward, which is accomplished in that the actuating drives 37 pull the beam 35 toward the outside of the machine 1, after which the spring-loaded slides 25 can push the terminal backup rollers 23 in the same outward direction. The terminal leveling roller supported by the terminal backup rollers 23 then follows, by virtue of its weight, the movement of the terminal backup rollers 23 and swings downward.

As can be seen in FIG. 4, an initiator 45 is arranged at the front and rear of each of the lower bearing bars 41. The two initiators scan the lowered position of the lever arm 33 above the outer cover 43 and thus the lowered position of the terminal lower leveling roller 31. The advantage associated with the use of two initiators 45 is that it can be verified that the leveling roller 31 has been lowered along its entire length (at both bearing points).

The upper and lower leveling rollers 5 and 7 are driven by universal shafts (not shown).

With the inventive device, therefore, the possibility is created of producing an intentional overleveling of the metal stock at the outfeed end and/or to make it easier to feed the metal stock into the infeed end of the machine. It is also advantageous in particular that the mechanism for shifting and moving the terminal leveling roller(s) can be installed afterwards on already existing machines. The compactness of previous leveling machines without individually adjustable leveling roller(s) is thus essentially preserved.

The invention claimed is:

1. A device for leveling metal stock, which is moved during operation from an infeed side of the device to an outfeed side, comprising:

an upper set of leveling rollers and a lower set of leveling rollers, each of which comprises terminal leveling rollers on the infeed side and on the outfeed side, wherein the upper and lower sets of leveling rollers are arranged with an offset to each other, and wherein a plurality of upper and lower drive shafts is provided;

a plurality of lower backup roller support blocks, each of which comprises a plurality of backup rollers, which serve to support the lower leveling rollers and are arranged in rows, wherein axes of the backup rollers are parallel to axes of the leveling rollers;

at least one of the terminal lower leveling rollers of the set of lower leveling rollers is arranged so that it can be individually adjusted, wherein the at least one of the terminal lower leveling rollers is supported at each end in a lever arm, wherein each of the back up rollers support blocks includes a terminal back up roller and another back up roller immediately adjacent the terminal back up roller, the axis of rotation of the lever arm is the same as the axis of rotation of the backup roller immediately adjacent to the terminal backup roller;

the terminal backup rollers are assigned to the at least one of the terminal lower leveling rollers, these backup rollers being arranged to form a row, and are movable; and a mechanism for the synchronous movement of each said terminal backup rollers is provided, wherein the at least one of the terminal lower leveling rollers follows this movement.

2. A device according to claim 1, wherein the mechanism for moving each of the terminal backup rollers comprises a longitudinally movable slide for each backup roller of each of the backup roller support blocks.

3. A device according to claim 1, wherein the terminal backup rollers comprise a smaller diameter than the other backup rollers of the backup roller support blocks.

4. A device according to claim 1, wherein the lever arm is connected to a seating fixture for holding a last lower drive shaft.

5. A device according to claim 2, wherein the movement of the slide is horizontal.

6. A device according to claim 1, wherein the mechanisms for the synchronous movement of the terminal backup rollers comprise an actuating drive.

7. A device according to claim 6, wherein the actuating drive is one of a hydraulic cylinder, a hoist gear, and a spindle drive.

8. A device according to claim 6, wherein the actuating drive acts only from an edge toward the lower set of leveling rollers.

9. A device according to claim 1, wherein the mechanisms for the synchronous movement of the terminal backup rollers include a spring device, which acts in the lowering direction of the terminal leveling rollers.

10. A device according to claim 6, wherein the mechanism for moving each of the terminal backup rollers comprises a longitudinally movable slide for each backup roller of each of the backup roller support blocks, and between the actuating drive and the slide, a beam or yoke is provided to transmit the force of the actuating drive.

11. A device according to claim 1, wherein each lever arm, which supports the lower terminal leveling roller, is supported pivotably in a side bearing bar.

12. A device according to claim 1, wherein the at least one adjustable lower terminal leveling roller is arranged on the outfeed side and on the infeed side of the leveling device.

13. A device according to claim 12, wherein the mechanisms for adjusting the lower terminal leveling rollers are of identical design on the outfeed and infeed sides.

* * * * *